US009512679B2

(12) United States Patent
Rinzler et al.

(10) Patent No.: US 9,512,679 B2
(45) Date of Patent: Dec. 6, 2016

(54) METHODS AND APPARATUS FOR REMOVAL AND CONTROL OF MATERIAL IN LASER DRILLING OF A BOREHOLE

(71) Applicants: Charles C. Rinzler, Denver, CO (US); Mark S. Zediker, Castle Rock, CO (US); Brian O. Faircloth, Evergreen, CO (US); Joel F. Moxley, Denver, CO (US)

(72) Inventors: Charles C. Rinzler, Denver, CO (US); Mark S. Zediker, Castle Rock, CO (US); Brian O. Faircloth, Evergreen, CO (US); Joel F. Moxley, Denver, CO (US)

(73) Assignee: Foro Energy, Inc., Littleton, CO (US)

( * ) Notice: Subject to any disclaimer, the term of this patent is extended or adjusted under 35 U.S.C. 154(b) by 246 days.

(21) Appl. No.: 14/104,395

(22) Filed: Dec. 12, 2013

(65) Prior Publication Data

US 2015/0322738 A1 Nov. 12, 2015

Related U.S. Application Data

(62) Division of application No. 12/543,968, filed on Aug. 19, 2009, now Pat. No. 8,636,085.

(60) Provisional application No. 61/090,384, filed on Aug. 20, 2008, provisional application No. 61/102,730, filed on Oct. 3, 2008, provisional application No. 61/106,472, filed on Oct. 17, 2008, provisional application No. 61/153,271, filed on Feb. 17, 2009.

(51) Int. Cl.
*E21B 7/15* (2006.01)
*E21B 21/08* (2006.01)
(Continued)

(52) U.S. Cl.
CPC . *E21B 7/15* (2013.01); *E21B 7/14* (2013.01); *E21B 10/60* (2013.01); *E21B 21/00* (2013.01); *E21B 21/08* (2013.01); *E21B 21/103* (2013.01); *E21B 29/00* (2013.01); *E21B 43/11* (2013.01)

(58) Field of Classification Search
CPC ..... E21B 7/15; E21B 7/14; E21B 21/103; E21B 43/11; E21B 49/081; E21B 21/08; E21B 29/00; B23K 26/032; B23K 26/142; B23K 26/382; B23K 26/40; B23K 26/03; B23K 2203/50; G01N 21/31; G01N 2021/151; G01N 2030/0095
See application file for complete search history.

(56) References Cited

U.S. PATENT DOCUMENTS 4,090,572 A * 5/1978 Welch ..... B23K 26/1476 175/16
4,113,036 A * 9/1978 Stout ..... E21B 7/15 166/248

(Continued)

FOREIGN PATENT DOCUMENTS

JP 1987-011804 1/1987
JP 1993-118185 5/1993

(Continued)

OTHER PUBLICATIONS

Office Action from JP Application No. 2011-523959 dated Aug. 27, 2013.

(Continued)

*Primary Examiner* — Yong-Suk (Philip) Ro
(74) *Attorney, Agent, or Firm* — Glen P. Belvis; Steptoe & Johnson, LLP.

(57) ABSTRACT

The removal of material from the path of a high power laser beam during down hole laser operations including drilling of a borehole and removal of displaced laser effected borehole material from the borehole during laser operations. In particular, paths, dynamics and parameters of fluid flows for use in conjunction with a laser bottom hole assembly.

32 Claims, 6 Drawing Sheets

(51) Int. Cl.

| | |
|---|---|
| ***E21B 7/14*** | (2006.01) |
| ***E21B 10/60*** | (2006.01) |
| ***E21B 21/10*** | (2006.01) |
| ***E21B 29/00*** | (2006.01) |
| ***E21B 43/11*** | (2006.01) |
| ***E21B 21/00*** | (2006.01) |

(56) References Cited

U.S. PATENT DOCUMENTS

| | | | | |
|---|---|---|---|---|
| 4,282,940 | A * | 8/1981 | Salisbury | B26F 1/31 175/11 |
| 7,013,993 | B2 | 3/2006 | Masui | |
| 7,147,064 | B2 * | 12/2006 | Batarseh | E21B 7/15 175/11 |
| 2004/0026127 | A1 | 2/2004 | Masui | |
| 2006/0102343 | A1 * | 5/2006 | Skinner | E21B 7/15 166/250.1 |
| 2006/0237233 | A1 | 10/2006 | Reed | |
| 2007/0267220 | A1 | 11/2007 | Magiawala | |
| 2010/0044102 | A1 | 2/2010 | Rinzler | |
| 2010/0044103 | A1 | 2/2010 | Moxley | |
| 2010/0044104 | A1 | 2/2010 | Zediker | |
| 2010/0044105 | A1 | 2/2010 | Faircloth | |
| 2010/0044106 | A1 | 2/2010 | Zediker | |
| 2010/0078414 | A1 * | 4/2010 | Perry | B23K 26/106 219/121.67 |
| 2010/0111474 | A1 | 5/2010 | Satake | |
| 2010/0215326 | A1 | 8/2010 | Zediker | |
| 2012/0020631 | A1 | 1/2012 | Rinzler | |
| 2012/0067643 | A1 | 3/2012 | DeWitt | |
| 2012/0068086 | A1 | 3/2012 | DeWitt | |
| 2012/0074110 | A1 | 3/2012 | Zediker | |
| 2012/0217015 | A1 | 8/2012 | Zediker | |
| 2012/0217017 | A1 | 8/2012 | Zediker | |
| 2012/0217018 | A1 | 8/2012 | Zediker | |
| 2012/0217019 | A1 | 8/2012 | Zediker | |
| 2012/0248078 | A1 | 10/2012 | Zediker | |
| 2012/0255774 | A1 | 10/2012 | Grubb | |
| 2012/0255933 | A1 | 10/2012 | McKay | |
| 2012/0261188 | A1 | 10/2012 | Zediker | |
| 2012/0266803 | A1 | 10/2012 | Zediker | |
| 2012/0267168 | A1 | 10/2012 | Grubb | |
| 2012/0273269 | A1 | 11/2012 | Rinzler | |
| 2012/0273470 | A1 | 11/2012 | Zediker | |
| 2012/0275159 | A1 | 11/2012 | Fraze | |
| 2013/0011102 | A1 | 1/2013 | Rinzler | |
| 2013/0175090 | A1 | 7/2013 | Zediker | |
| 2013/0192893 | A1 | 8/2013 | Zediker | |
| 2013/0192894 | A1 | 8/2013 | Zediker | |
| 2013/0220626 | A1 | 8/2013 | Zediker | |
| 2013/0228372 | A1 | 9/2013 | Linyaev | |
| 2013/0228557 | A1 | 9/2013 | Zediker | |
| 2013/0266031 | A1 | 10/2013 | Norton | |
| 2013/0319984 | A1 | 12/2013 | Linyaev | |
| 2014/0000902 | A1 | 1/2014 | Wolfe | |
| 2014/0060802 | A1 | 3/2014 | Zediker | |
| 2014/0060930 | A1 | 3/2014 | Zediker | |
| 2014/0069896 | A1 | 3/2014 | Deutch | |
| 2014/0090846 | A1 | 4/2014 | Deutch | |
| 2014/0190949 | A1 | 7/2014 | Zediker | |
| 2014/0231085 | A1 | 8/2014 | Zediker | |
| 2014/0231398 | A1 | 8/2014 | Land | |
| 2014/0248025 | A1 | 9/2014 | Rinzler | |
| 2014/0345872 | A1 | 11/2014 | Zediker | |

FOREIGN PATENT DOCUMENTS

| | | |
|---|---|---|
| JP | 1993-33574 | 9/1993 |
| JP | 2001-208924 | 8/2001 |
| JP | 2003-239673 | 8/2003 |
| JP | 2004-108132 | 4/2004 |
| JP | 2006-039147 | 2/2006 |
| JP | 2006-509253 | 3/2006 |
| JP | 2008-242012 | 10/2008 |
| WO | WO2004/052078 | 6/2004 |

OTHER PUBLICATIONS

Office Action from JP Application No. 2011-551172 dated Sep. 17, 2013.

* cited by examiner

METHODS AND APPARATUS FOR REMOVAL AND CONTROL OF MATERIAL IN LASER DRILLING OF A BOREHOLE

This application is a divisional of Ser. No. 12/543,968 filed Aug. 19, 2009, which claims the benefit of priority of provisional applications: Ser. No. 61/090,384 filed Aug. 20, 2008, titled System and Methods for Borehole Drilling: Ser. No. 61/102,730 filed Oct. 3, 2008, titled Systems and Methods to Optically Pattern Rock to Chip Rock Formations; Ser. No. 61/106,472 filed Oct. 17, 2008, titled Transmission of High Optical Power Levels via Optical Fibers for Applications such as Rock Drilling and Power Transmission; and, Ser. No. 61/153,271 filed Feb. 17, 2009, title Method and Apparatus for an Armored High Power Optical Fiber for Providing Boreholes in the Earth, the disclosures of which are incorporated herein by reference.

This invention was made with Government support under Award DE-AR0000044 awarded by the Office of ARPA-E U.S. Department of Energy. The Government has certain rights in this invention.

BACKGROUND OF THE INVENTION

The present invention relates to methods, apparatus and systems for delivering high power laser energy over long distances, while maintaining the power of the laser energy to perform desired tasks. In a particular, the present invention relates to paths, dynamics and parameters of fluid flows used in conjunction with a laser bottom hole assembly (LBHA) for the control and removal of material in conjunction with the creation and advancement of a borehole in the earth by the delivery of high power laser energy to the bottom of a borehole.

The present invention is useful with and may be employed in conjunction with the systems, apparatus and methods that are disclosed in greater detail in U.S. patent application Ser. No. 12/544,136, titled Method and Apparatus for Delivering High Power Laser Energy Over Long Distances, (issued as U.S. Pat. No. 8,511,401), U.S. patent application Ser. No. 12/544,038, titled Apparatus for Advancing a Wellbore using High Power Laser Energy, and U.S. patent application Ser. No. 12/544,094, titled Methods and Apparatus for Delivering High Power Laser Energy to a Surface (issued as U.S. Pat. No. 8,424,617), filed contemporaneously with parent application Ser. No. 12/543,968, the disclosures of which are incorporate herein by reference in their entirety.

In general, boreholes have been formed in the earth's surface and the earth, i.e., the ground, to access resources that are located at and below the surface. Such resources would include hydrocarbons, such as oil and natural gas, water, and geothermal energy sources, including hydrothermal wells. Boreholes have also been formed in the ground to study, sample and explore materials and formations that are located below the surface. They have also been formed in the ground to create passageways for the placement of cables and other such items below the surface of the earth.

The term borehole includes any opening that is created in the ground that is substantially longer than it is wide, such as a well, a well bore, a well hole, and other terms commonly used or known in the art to define these types of narrow long passages in the earth. Although boreholes are generally oriented substantially vertically, they may also be oriented on an angle from vertical, to and including horizontal. Thus, using a level line as representing the horizontal orientation, a borehole can range in orientation from 0° i.e., a vertical borehole, to 90°, i.e., a horizontal borehole and greater than 90° e.g., such as a heel and toe. Boreholes may further have segments or sections that have different orientations, they may be arcuate, and they may be of the shapes commonly found when directional drilling is employed. Thus, as used herein unless expressly provided otherwise, the "bottom" of the borehole, the "bottom" surface of the borehole and similar terms refer to the end of the borehole, i.e., that portion of the borehole farthest along the path of the borehole from the borehole's opening, the surface of the earth, or the borehole's beginning.

Advancing a borehole means to increase the length of the borehole. Thus, by advancing a borehole, other than a horizontal one, the depth of the borehole is also increased. Boreholes are generally formed and advanced by using mechanical drilling equipment having a rotating drilling bit. The drilling bit is extending to and into the earth and rotated to create a hole in the earth. In general, to perform the drilling operation a diamond tip tool is used. That tool must be forced against the rock or earth to be cut with a sufficient force to exceed the shear strength of that material. Thus, in conventional drilling activity mechanical forces exceeding the shear strength of the rock or earth must be applied to that material. The material that is cut from the earth is generally known as cuttings, i.e., waste, which may be chips of rock, dust, rock fibers and other types of materials and structures that may be created by the thermal or mechanical interactions with the earth. These cuttings are typically removed from the borehole by the use of fluids, which fluids can be liquids, foams or gases.

In addition to advancing the borehole, other types of activities are performed in or related to forming a borehole, such as, work over and completion activities. These types of activities would include for example the cutting and perforating of casing and the removal of a well plug. Well casing, or casing, refers to the tubulars or other material that are used to line a wellbore. A well plug is a structure, or material that is placed in a borehole to fill and block the borehole. A well plug is intended to prevent or restrict materials from flowing in the borehole.

Typically, perforating, i.e., the perforation activity, involves the use of a perforating tool to create openings, e.g. windows, or a porosity in the casing and borehole to permit the sought after resource to flow into the borehole. Thus, perforating tools may use an explosive charge to create, or drive projectiles into the casing and the sides of the borehole to create such openings or porosities.

The above mentioned conventional ways to form and advance a borehole are referred to as mechanical techniques, or mechanical drilling techniques, because they require a mechanical interaction between the drilling equipment, e.g., the drill bit or perforation tool, and the earth or casing to transmit the force needed to cut the earth or casing.

There is a need for the removal of cuttings or waste material that are created as the borehole is advanced, or as other cutting or material removal activities take place, as a result of the laser beam illumination of material. There is further a need for keeping the laser path clear, or at a minimum sufficiently free of debris or material to prevent adverse effects on, or loss of power of, the laser beam. The present invention addresses and provides solutions to these and other needs in the drilling arts by providing, among other things, paths, dynamics and parameters of fluid flows used in conjunction with laser drilling or an LBHA for the control and removal of material in conjunction with the creation and advancement of a borehole in the earth by the delivery of high power laser energy to the bottom of a borehole.

SUMMARY

It is desirable to develop systems and methods that provide for the delivery of high power laser energy to the bottom of a deep borehole to advance that borehole at a cost effect rate, and in particular, to be able to deliver such high power laser energy to drill through rock layer formations including granite, basalt, sandstone, dolomite, sand, salt, limestone, rhyolite, quartzite and shale rock at a cost effective rate. More particularly, it is desirable to develop systems and methods that provide for the ability to be able to deliver such high power laser energy to drill through hard rock layer formations, such as granite and basalt, at a rate that is superior to prior conventional mechanical drilling operations. The present invention, among other things, solves these needs by providing the system, apparatus and methods taught herein.

Thus, there is provided a method of removing debris from a borehole during laser drilling of the borehole the method comprising: directing a laser beam comprising a wavelength, and having a power of at least about 10 kW, down a borehole and towards a surface of a borehole; the surface being at least 1000 feet within the borehole; the laser beam illuminating an area of the surface; the laser beam displacing material from the surface in the area of illumination; directing a fluid into the borehole and to the borehole surface; the fluid being substantially transmissive to the laser wavelength; the directed fluid having a first and a second flow path; the fluid flowing in the first flow path removing the displaced material from the area of illumination at a rate sufficient to prevent the displaced material from interfering with the laser illumination of the area of illumination; and, the fluid flowing in the second flow path removing displaced material form borehole. Additionally, the forging method may also have the illumination area rotated, the fluid in the first fluid flow path directed in the direction of the rotation, the fluid in the first fluid flow path directed in a direction opposite of the rotation, a third fluid flow path, the third fluid low path and the first fluid flow path in the direction of rotation, the third fluid low path and the first fluid flow path in a direction opposite to the direction of rotation, the fluid directed directly at the area of illumination, the fluid in the first flow path directed near the area of illumination, and the fluid in the first fluid flow path directed near the area of illumination, which area is ahead of the rotation.

There is yet further provided a method of removing debris from a borehole during laser drilling of the borehole the method comprising: directing a laser beam having at least about 10 kW of power towards a borehole surface; illuminating an area of the borehole surface; displacing material from the area of illumination; providing a fluid; directing the fluid toward a first area within the borehole; directing the fluid toward a second area; the directed fluid removing the displaced material from the area of illumination at a rate sufficient to prevent the displaced material from interfering with the laser illumination; and, the fluid removing displaced material form borehole. This further method may additionally have the first area as the area of illumination, the second area on a sidewall of a bottom hole assembly, the second area near the first area and the second area located on a bottom surface of the borehole, the second area near the first area when the second area is located on a bottom surface of the borehole, a first fluid directed to the area of illumination and a second fluid directed to the second area, the first fluid as nitrogen, the first fluid as a gas, the second fluid as a liquid, and the second fluid as an aqueous liquid.

Yet further there is provided a method of removing debris from a borehole during laser drilling of the borehole the method comprising: directing a laser beam towards a borehole surface; illuminating an area of the borehole surface; displacing material from the area of illumination; providing a fluid; directing the fluid in a first path toward a first area within the borehole; directing the fluid in a second path toward a second area; amplifying the flow of the fluid in the second path; the directed fluid removing the displaced material from the area of illumination at a rate sufficient to prevent the displaced material from interfering with the laser illumination; and, the amplified fluid removing displaced material form borehole.

Moreover there is provided a laser bottom hole assembly for drilling a borehole in the earth comprising: a housing; optics for shaping a laser beam; an opening for delivering a laser beam to illuminate the surface of a borehole; a first fluid opening in the housing; a second fluid opening in the housing; and, the second fluid opening comprising a fluid amplifier.

Still further a high power laser drilling system for advancing a borehole is provided that comprises: a source of high power laser energy, the laser source capable of providing a laser beam; a tubing assembly, the tubing assembly having at least 500 feet of tubing, having a distal end and a proximal; a source of fluid for use in advancing a borehole; the proximal end of the tubing being in fluid communication with the source of fluid, whereby fluid is transported in association with the tubing from the proximal end of the tubing to the distal end of the tubing; the proximal end of the tubing being in optical communication with the laser source, whereby the laser beam can be transported in association with the tubing; the tubing comprising a high power laser transmission cable, the transmission cable having a distal end and a proximal end, the proximal end being in optical communication with the laser source, whereby the laser beam is transmitted by the cable from the proximal end to the distal end of the cable; and, a laser bottom hole assembly in optical and fluid communication with the distal end of the tubing; and, the laser bottom hole assembly comprising; a housing; an optical assembly; and, a fluid directing opening. This system may be supplemented by also having the fluid directing opening as an air knife, the fluid directing opening as a fluid amplifier, the fluid directing opening is an air amplifier, a plurality of fluid directing apparatus, the bottom hole assembly comprising a plurality of fluid directing openings, the housing comprising a first housing and a second housing; the fluid directing opening located in the first housing, and a means for rotating the first housing, such as a motor, There is yet further provided a high power laser drilling system for advancing a borehole comprising: a source of high power laser energy, the laser source capable of providing a laser beam; a tubing assembly, the tubing assembly having at least 500 feet of tubing, having a distal end and a proximal; a source of fluid for use in advancing a borehole; the proximal end of the tubing being in fluid communication with the source of fluid, whereby fluid is transported in association with the tubing from the proximal end of the tubing to the distal end of the tubing; the proximal end of the tubing being in optical communication with the laser source, whereby the laser beam can be transported in association with the tubing; the tubing comprising a high power laser transmission cable, the transmission cable having a distal end and a proximal end, the proximal end being in optical communication with the laser source, whereby the laser beam is transmitted by the cable from the proximal end to the distal end of the cable; and, a laser bottom hole assembly in optical and fluid communication with the distal end of the tubing; and, a fluid directing means for removal of waste material.

Further such systems may additionally have the fluid directing means located in the laser bottom hole assembly, the laser bottom hole assembly having a means for reducing the interference of waste material with the laser beam, the laser bottom hole assembly with rotating laser optics, and the laser bottom hole assembly with rotating laser optics and rotating fluid directing means.

One of ordinary skill in the art will recognize, based on the teachings set forth in these specifications and drawings, that there are various embodiments and implementations of these teachings to practice the present invention. Accordingly, the embodiments in this summary are not meant to limit these teachings in any way.

DESCRIPTION OF THE DRAWINGS AND THE PREFERRED EMBODIMENTS

Figure 1A:
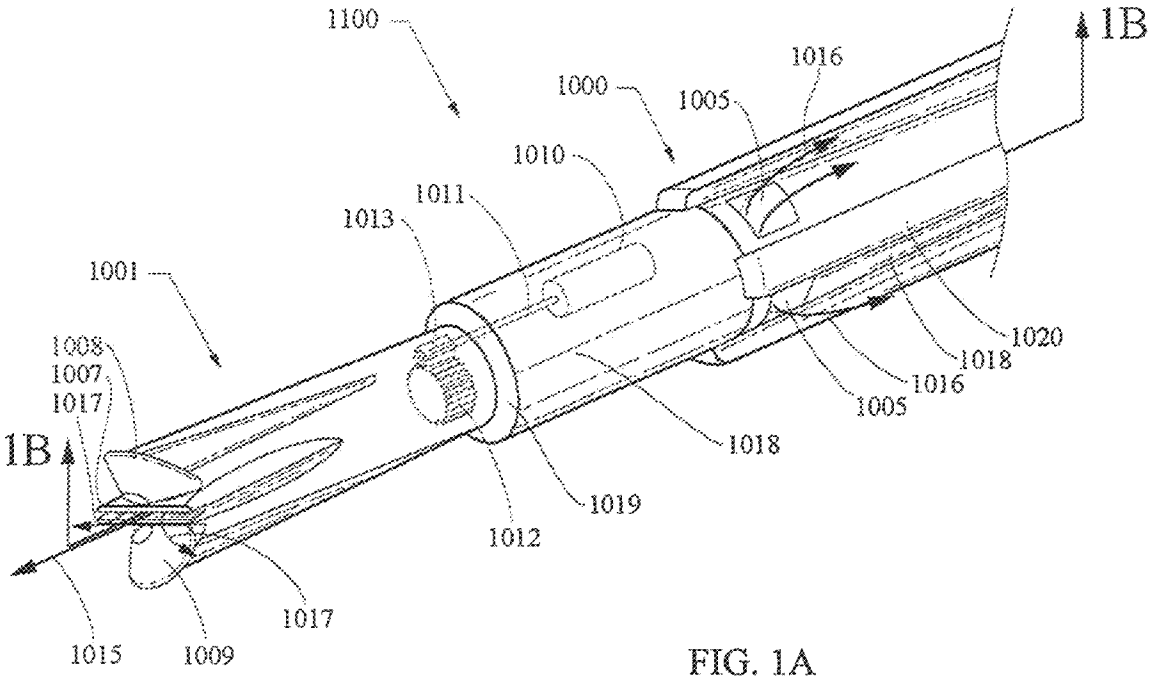
FIG. 1A is a perspective view of an LBHA.

In general, the present inventions relate to methods, apparatus and systems for use in laser drilling of a borehole in the earth, and further, relate to equipment, methods and systems for the laser advancing of such boreholes deep into the earth and at highly efficient advancement rates. These highly efficient advancement rates are obtainable in part because the present invention provides paths, dynamics and parameters of fluid flows used in conjunction with a laser bottom hole assembly (LBHA) for the control and removal of material in conjunction with the creation and advancement of a borehole in the earth by the delivery of high power laser energy to the surfaces of the borehole. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

In general, one or more laser beams generated or illuminated by one or more lasers may spall, vaporize or melt material such as rock or earth. The laser beam may be pulsed by one or a plurality of waveforms or it may be continuous. The laser beam may generally induce thermal stress in a rock formation due to characteristics of the rock including, for example, the thermal conductivity. The laser beam may also induce mechanical stress via superheated steam explosions of moisture in the subsurface of the rock formation. Mechanical stress may also be induced by thermal decomposition and sublimation of part of the in situ minerals of the material. Thermal and/or mechanical stress at or below a laser-material interface may promote spallation of the material, such as rock. Likewise, the laser may be used to effect well casings, cement or other bodies of material as desired. A laser beam may generally act on a surface at a location where the laser beam contacts the surface, which may be referred to as a region of laser illumination. The region of laser illumination may have any preselected shape and intensity distribution that is required to accomplish the desired outcome, the laser illumination region may also be referred to as a laser beam spot. Boreholes of any depth and/or diameter may be formed, such as by spalling multiple points or layers. Thus, by way of example, consecutive points may be targeted or a strategic pattern of points may be targeted to enhance laser/rock interaction. The position or orientation of the laser or laser beam may be moved or directed so as to intelligently act across a desired area such that the laser/material interactions are most efficient at causing rock removal.

Generally in downhole operations including drilling, completion, and workover, the bottom hole assembly is an assembly of equipment that typically is positioned at the end of a cable, wireline, umbilical, string of tubulars, string of drill pipe, or coiled tubing and is lower into and out of a borehole. It is this assembly that typically is directly involved with the drilling, completion, or workover operation and facilitates an interaction with the surfaces of the borehole, casing, or formation to advance or otherwise enhance the borehole as desired.

In general, the LBHA may contain an outer housing that is capable of withstanding the conditions of a downhole environment, a source of a high power laser beam, and optics for the shaping and directing a laser beam on the desired surfaces of the borehole, casing, or formation. The high power laser beam may be greater than about 1 kW, from about 2 kW to about 20 kW, greater than about 5 kW, from about 5 kW to about 10 kW, preferably at least about 10 kW, at least about 15 kW, and at least about 20 kW. The assembly may further contain or be associated with a system for delivering and directing fluid to the desired location in the borehole, a system for reducing or controlling or managing debris in the laser beam path to the material surface, a means to control or manage the temperature of the optics, a means to control or manage the pressure surrounding the optics, and other components of the assembly, and monitoring and measuring equipment and apparatus, as well as, other types of downhole equipment that are used in conventional mechanical drilling operations. Further, the LBHA may incorporate a means to enable the optics to shape and propagate the beam which for example would include a means to control the index of refraction of the environment through which the laser is propagating. Thus, as used herein the terms control and manage are understood to be used in their broadest sense and would include active and passive measures as well as design choices and materials choices.

The LBHA should be construed to withstand the conditions found in boreholes including boreholes having depths of about 1,640 ft (0.5 km) or more, about 3,280 ft (1 km) or more, about 9,830 ft (3 km) or more, about 16,400 ft (5 km) or more, and up to and including about 22,970 ft (7 km) or more. While drilling, i.e. advancement of the borehole, is taking place the desired location in the borehole may have dust, drilling fluid, and/or cuttings present. Thus, the LBHA should be constructed of materials that can withstand these pressures, temperatures, flows, and conditions, and protect the laser optics that are contained in the LBHA. Further, the LBHA should be designed and engineered to withstand the downhole temperatures, pressures, and flows and conditions while managing the adverse effects of the conditions on the operation of the laser optics and the delivery of the laser beam.

The LBHA should also be constructed to handle and deliver high power laser energy at these depths and under the extreme conditions present in these deep downhole environments. Thus, the LBHA and its laser optics should be capable of handling and delivering laser beams having energies of 1 kW or more, 5 kW or more, 10 kW or more and 20 kW or more. This assembly and optics should also be capable of delivering such laser beams at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more.

The LBHA should also be able to operate in these extreme downhole environments for extended periods of time. The lowering and raising of a bottom hole assembly has been referred to as tripping in and tripping out. While the bottom hole assembling is being tripped in or out the borehole is not being advanced. Thus, reducing the number of times that the bottom hole assembly needs to be tripped in and out will reduce the critical path for advancing the borehole, i.e., drilling the well, and thus will reduce the cost of such drilling. (As used herein the critical path referrers to the least number of steps that must be performed in serial to complete the well.) This cost savings equates to an increase in the drilling rate efficiency. Thus, reducing the number of times that the bottom hole assembly needs to be removed from the borehole directly corresponds to reductions in the time it takes to drill the well and the cost for such drilling. Moreover, since most drilling activities are based upon day rates for drilling rigs, reducing the number of days to complete a borehole will provided a substantial commercial benefit. Thus, the LBHA and its laser optics should be capable of handling and delivering laser beams having energies of 1 kW or more, 5 kW or more, 10 kW or more and 20 kW or more at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more, for at least about ½ hr or more, at least about 1 hr or more, at least about 2 hours or more, at least about 5 hours or more, and at least about 10 hours or more, and preferably longer than any other limiting factor in the advancement of a borehole. In this way using the LBHA of the present invention could reduce tripping activities to only those that are related to casing and completion activities, greatly reducing the cost for drilling the well.

In accordance with one or more embodiments, the fiber optics forming a pattern can send any desired amount of power. In some non-limiting embodiments, fiber optics may send up to 10 kW or more per a fiber. The fibers may transmit any desired wavelength. In some embodiments, the range of wavelengths the fiber can transmit may preferably be between about 800 nm and 2100 nm. The fiber can be connected by a connector to another fiber to maintain the proper fixed distance between one fiber and neighboring fibers. For example, fibers can be connected such that the beam spot from neighboring optical fibers when irradiating the material, such as a rock surface are non-overlapping to the particular optical fiber. The fiber may have any desired core size. In some embodiments, the core size may range from about 50 microns to 600 microns. The fiber can be single mode or multimode. If multimode, the numerical aperture of some embodiments may range from 0.1 to 0.6. A lower numerical aperture may be preferred for beam quality, and a higher numerical aperture may be easier to transmit higher powers with lower interface losses. In some embodiments, a fiber laser emitted light at wavelengths comprised of 1060 nm to 1080 nm, 1530 nm to 1600 nm, 1800 nm to 2100 nm, diode lasers from 400 nm to 2100 nm, $CO_2$ Laser at 10,600 nm, or Nd:YAG Laser emitting at 1064 nm can couple to the optical fibers. In some embodiments, the fiber can have a low water content. The fiber can be jacketed, such as with polyimide, acrylate, carbon polyamide, and carbon/dual acrylate or other material. If requiring high temperatures, a polyimide or a derivative material may be used to operate at temperatures over 300 degrees Celsius. The fibers can be a hollow core photonic crystal or solid core photonic crystal. In some embodiments, using hollow core photonic crystal fibers at wavelengths of 1500 nm or higher may minimize absorption losses.

The use of the plurality of optical fibers can be bundled into a number of configurations to improve power density. The optical fibers forming a bundle may range from two fibers at hundreds of watts to kilowatt powers in each fiber to millions of fibers at milliwatts or microwatts of power.

In accordance with one or more embodiments, one or more diode lasers can be sent downhole with an optical element system to form one or more beam spots, shapes, or patterns. The one or more diode lasers will typically require control over divergence. For example, using a collimator a focus distance away or a beam expander and then a collimator may be implemented. In some embodiments, more than one diode laser may couple to fiber optics, where the fiber optics or a plurality of fiber optic bundles form a pattern of beam spots irradiating the material, such as a rock surface. In another embodiment, a diode laser may feed a single mode fiber laser head. Where the diode laser and single mode fiber laser head are both downhole or diode laser is above hole and fiber laser head is downhole, the light being irradiated is collimated and an optical lens system would not require a collimator. In another embodiment, a fiber laser head unit may be separated in a pattern to form beam spots to irradiate the rock surface.

Figure 1B:
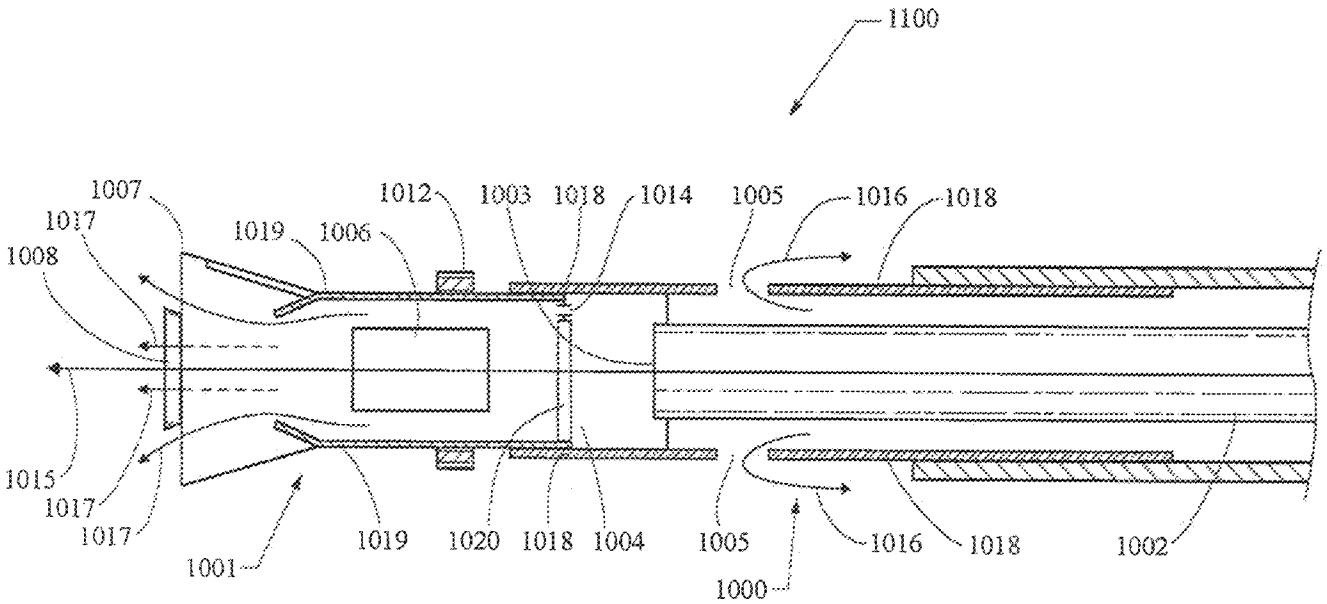
FIG. 1B is a cross sectional view of the LBHA of FIG. 1A taken along B-B.

Thus, by way of example, an LBHA is illustrated in FIGS. 1A and B, which are collectively referred as FIG. 1. There is provided a LBHA 1100, which has an upper part 1000 and a lower part 1001. The upper part 1000 has housing 1018 and the lower part 1001 has housing 1019. The LBHA 1100, the upper part 1000, the lower part 1001 and in particular the housings 1018, 1019 should be constructed of materials and designed structurally to withstand the extreme conditions of the deep downhole environment and protect any of the components that are contained within them.

The upper part 1000 may be connected to the lower end of the coiled tubing, drill pipe, or other means to lower and retrieve the LBHA 1100 from the borehole. Further, it may be connected to stabilizers, drill collars, or other types of downhole assemblies (not shown in the figure), which in turn are connected to the lower end of the coiled tubing, drill pipe, or other means to lower and retrieve the LBHA 1100 from the borehole. The upper part 1000 further contains, is connect to, or otherwise optically associated with the means 1002 that transmitted the high power laser beam down the borehole so that the beam exits the lower end 1003 of the means 1002 and ultimately exits the LBHA 1100 to strike the intended surface of the borehole. The beam path of the high power laser beam is shown by arrow 1015. In FIG. 1 the means 1002 is shown as a single optical fiber. The upper part 1000 may also have air amplification nozzles 1005 that discharge the drilling fluid, for example $N_2$, to among other things assist in the removal of cuttings up the borehole.

The upper part 1000 further is attached to, connected to or otherwise associated with a means to provide rotational movement 1010. Such means, for example, would be a downhole motor, an electric motor or a mud motor. The motor may be connected by way of an axle, drive shaft, drive train, gear, or other such means to transfer rotational motion 1011, to the lower part 1001 of the LBHA 1100. It is understood, as shown in the drawings for purposes of illustrating the underlying apparatus, that a housing or protective cowling may be placed over the drive means or otherwise associated with it and the motor to protect it form debris and harsh downhole conditions. In this manner the motor would enable the lower part 1001 of the LBHA 1100 to rotate. An example of a mud motor is the CAVO 1.7" diameter mud motor. This motor is about 7 ft long and has the following specifications: 7 horsepower@110 ft-lbs full torque; motor speed 0-700 rpm; motor can run on mud, air, $N_2$, mist, or foam; 180 SCFM, 500-800 psig drop; support equipment extends length to 12 ft; 10:1 gear ratio provides 0-70 rpm capability; and has the capability to rotate the lower part 1001 of the LBHA through potential stall conditions.

The upper part 1000 of the LBHA 1100 is joined to the lower part 1001 with a sealed chamber 1004 that is transparent to the laser beam and forms a pupil plane 1020 to permit unobstructed transmission of the laser beam to the beam shaping optics 1006 in the lower part 1001. The lower part 1001 is designed to rotate. The sealed chamber 1004 is in fluid communication with the lower chamber 1001 through port 1014. Port 1014 may be a one way valve that permits clean transmissive fluid and preferably gas to flow from the upper part 1000 to the lower part 1001, but does not permit reverse flow, or if may be another type of pressure and/or flow regulating value that meets the particular requirements of desired flow and distribution of fluid in the downhole environment. Thus, for example there is provided in FIG. 1 a first fluid flow path, shown by arrows 1016, and a second fluid flow path, shown by arrows 1017. In the example of FIG. 1 the second fluid flow path is a laminar flow although other flows including turbulent flows may be employed.

The lower part 1001 has a means for receiving rotational force from the motor 1010, which in the example of the figure is a gear 1012 located around the lower part housing 1019 and a drive gear 1013 located at the lower end of the axle 1011. Other means for transferring rotational power may be employed or the motor may be positioned directly on the lower part. It being understood that an equivalent apparatus may be employed which provide for the rotation of the portion of the LBHA to facilitate rotation or movement of the laser beam spot while that he same time not providing undue rotation, or twisting forces, to the optical fiber or other means transmitting the high power laser beam down the hole to the LBHA. In his way laser beam spot can be rotated around the bottom of the borehole. The lower part 1001 has a laminar flow outlet 1007 for the fluid to exit the LBHA 1100, and two hardened rollers 1008, 1009 at its lower end. Although a laminar flow is contemplated in this example, it should be understood that non-laminar flows, and turbulent flows may also be employed.

The two hardened rollers may be made of a stainless steel or a steel with a hard face coating such as tungsten carbide, chromium-cobalt-nickel alloy, or other similar materials. They may also contain a means for mechanically cutting rock that has been thermally degraded by the laser. They may range in length from about 1 in to about 4 inches and preferably are about 2-3 inches and may be as large as or larger than 6 inches. Moreover in LBHAs for drilling larger diameter boreholes they may be in the range of 10-20 inches to 30 inches in diameter.

Thus, FIG. 1 provides for a high power laser beam path 1015 that enters the LBHA 1100, travels through beam spot shaping optics 1006, and then exits the LBHA to strike its intended target on the surface of a borehole. Further, although it is not required, the beam spot shaping optics may also provide a rotational element to the spot, and if so, would be considered to be beam rotational and shaping spot optics.

In use the high energy laser beam, for example greater than 15 kW, would enter the LBHA 1100, travel down fiber 1002, exit the end of the fiber 1003 and travel through the sealed chamber 1004 and pupil plane 1020 into the optics 1006, where it would be shaped and focused into a spot, the optics 1006 would further rotate the spot. The laser beam would then illuminate, in a potentially rotating manner, the bottom of the borehole spalling, chipping, melting, and/or vaporizing the rock and earth illuminated and thus advance the borehole. The lower part would be rotating and this rotation would further cause the rollers 1008, 1009 to physically dislodge any material that was effected by the laser or otherwise sufficiently fixed to not be able to be removed by the flow of the drilling fluid alone.

The cuttings would be cleared from the laser path by the flow of the fluid along the path 1017, as well as, by the action of the rollers 1008, 1009 and the cuttings would then be carried up the borehole by the action of the drilling fluid from the air amplifiers 1005, as well as, the laminar flow opening 1007.

It is understood that the configuration of the LBHA is FIG. 1 is by way of example and that other configurations of its components are available to accomplish the same results. Thus, the motor may be located in the lower part rather than the upper part, the motor may be located in the upper part but only turn the optics in the lower part and not the housing. The optics may further be located in both the upper and lower parts, which the optics for rotation being positioned in that part which rotates. The motor may be located in the lower part but only rotate the optics and the rollers. In this later configuration the upper and lower parts could be the same, i.e., there would only be one part to the LBHA. Thus, for example the inner portion of the LBHA may rotate while the outer portion is stationary or vice versa, similarly the top and/or bottom portions may rotate or various combinations of rotating and non-rotating components may be employed, to provide for a means for the laser beam spot to be moved around the bottom of the borehole.

The optics 1006 should be selected to avoid or at least minimize the loss of power as the laser beam travels through them. The optics should further be designed to handle the extreme conditions present in the downhole environment, at least to the extent that those conditions are not mitigated by the housing 1019. The optics may provide laser beam spots of differing power distributions and shapes as set forth herein above. The optics may further provide a sign spot or multiple spots as set forth herein above. Further examples of optics, beam profiles and high power laser beam spots for use in and with a LBHA are provide are disclosed in greater detail in co-pending U.S. patent application Ser. No. 12/544,094, filed contemporaneously with parent application Ser. No. 12/543,968, the disclosure of which is incorporate herein by reference in its entirety.

Figure 2:
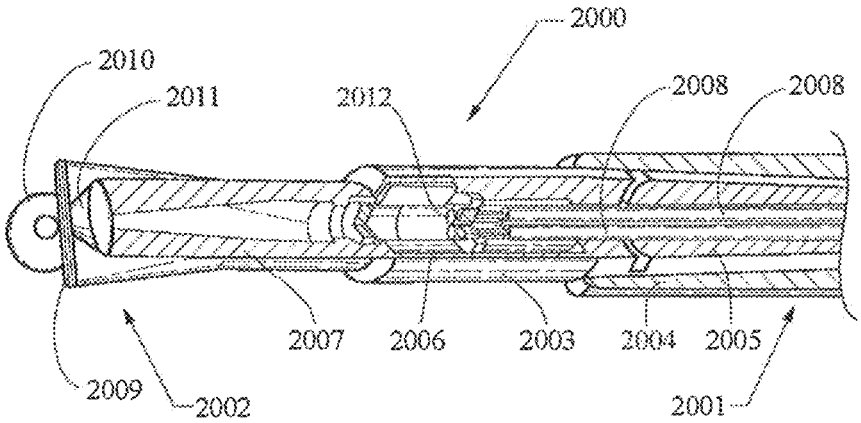
FIG. 2 is a cutaway perspective view of an LBHA

In general, and by way of further example, there is provided in FIG. 2 a LBHA 2000 comprises an upper end 2001, and a lower end 2002. The high power laser beam enters through the upper end 2001 and exist through the lower end 2002 in a predetermined selected shape for the removal of material in a borehole, including the borehole surface, casing, or tubing. The LBHA 2000 further comprises a housing 2003, which may by way of example, be made up of sub-housings 2004, 2005, 2006 and 2007. These sub-housings may be integral, they may be separable, they may be removably fixedly connected, they may be rotatable, or there may be any combination of one or more of these types of relationships between the sub-housings. The LBHA 2000 may be connected to the lower end of the coiled tubing, drill pipe, or other means to lower and retrieve the LBHA 2000 from the borehole. Further, it may be connected to stabilizers, drill collars, or other types of down hole assemblies (not shown in the figure) which in turn are connected to the lower end of the coiled tubing, drill pipe, or other means to lower and retrieve the bottom hole assembly from the borehole. The LBHA 2000 has associated therewith a means 2008 that transmitted the high power energy from down the borehole. In FIG. 2 this means 2008 is a bundle four optical cables.

The LBHA may also have associated with, or in, it means to handle and deliver drilling fluids. These means may be associated with some or all of the sub-housings. In FIG. 2 there is provided, as such a means, a nozzle 2009 in sub-housing 2007. There are further provided mechanical scraping means, e.g. a Polycrystalline diamond composite or compact (PDC) bit and cutting tool, to remove and/or direct material in the borehole, although other types of known bits and/or mechanical drilling heads by also be employed in conjunction with the laser beam. In FIG. 2, such means are show by hardened scrapers 2010 and 2011. These scrapers may be mechanically interacted with the surface or parts of the borehole to loosen, remove, scrap or manipulate such borehole material as needed. These scrapers may be from less than about 1 in to about 20 in in length. In use the high energy laser beam, for example greater than 15 kW, would travel down the fibers 2008 through 2012 optics and then out the lower end 2002 of the LBHA 2000 to illuminate the intended part of the borehole, or structure contained therein, spalling, melting and/or vaporizing the material so illuminated and thus advance the borehole or otherwise facilitating the removal of the material so illuminated. Thus, these types of mechanical means which may be crushing, cutting, gouging scraping, grinding, pulverizing, and shearing tools, or other tools used for mechanical removal of material from a borehole, may be employed in conjunction with or association with a LBHA. As used herein the "length" of such tools refers to its longest dimension.

Drilling may be conducted in a dry environment or a wet environment. An important factor is that the path from the laser to the rock surface should be kept as clear as practical of debris and dust particles or other material that would interfere with the delivery of the laser beam to the rock surface. The use of high brightness lasers provides another advantage at the process head, where long standoff distances from the last optic to the work piece are important to keeping the high pressure optical window clean and intact through the drilling process. The beam can either be positioned statically or moved mechanically, opto-mechanically, electro-optically, electromechanically, or any combination of the above to illuminate the earth region of interest.

Figure 4:
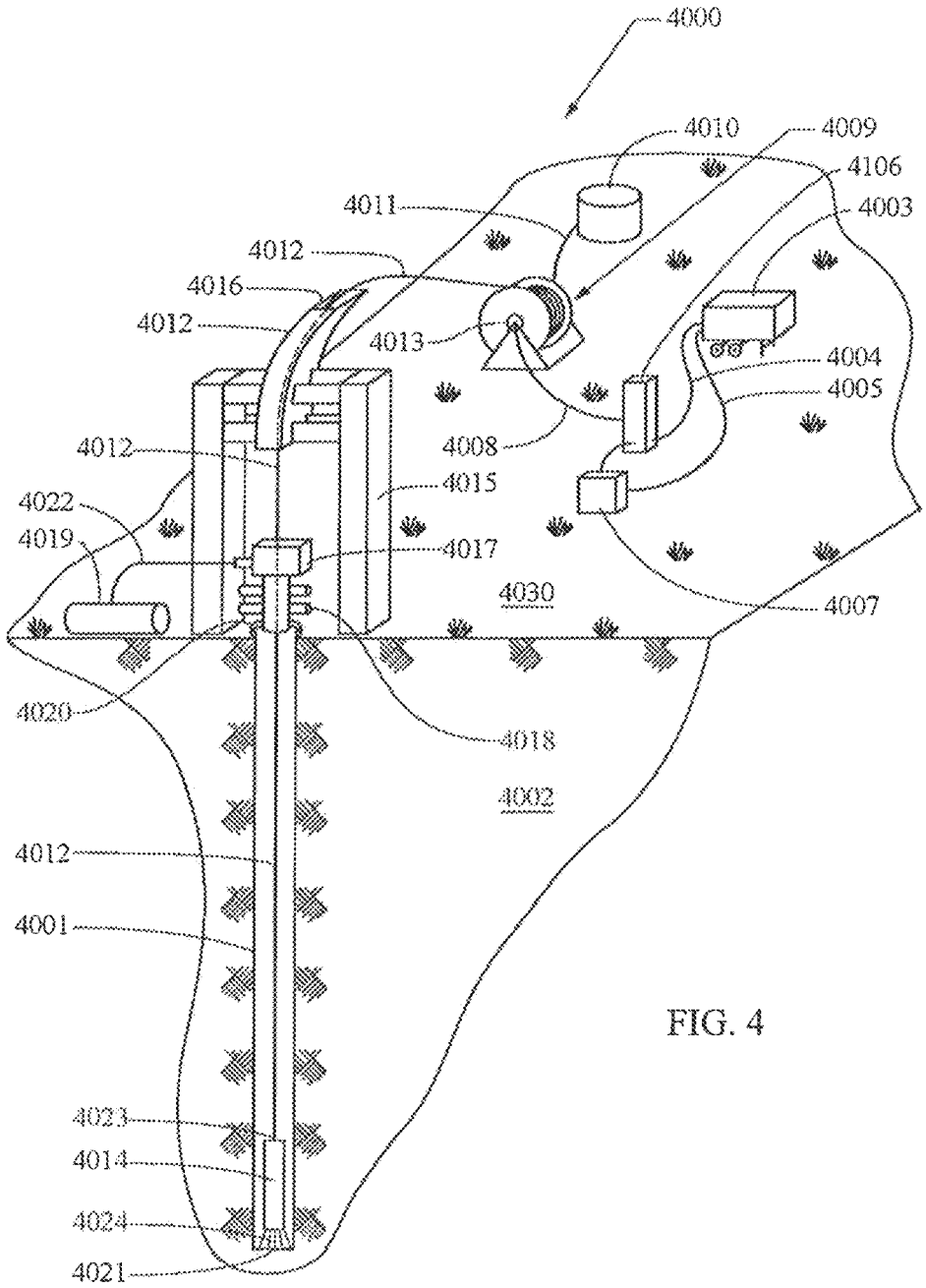
FIG. 4 is a diagram of laser drilling system.

Thus, in general, and by way of example, there is provided in FIG. 4 a high efficiency laser drilling system 4000 for creating a borehole 4001 in the earth 4002; such systems are disclosed in greater detail in co-pending U.S. patent application Ser. No. 12/544,136, filed contemporaneously with parent application Ser. No. 12/543,968, the disclosure of which is incorporate herein by reference in its entirety FIG. 4 provides a cut away perspective view showing the surface of the earth 4030 and a cut away of the earth below the surface 4002. In general and by way of example, there is provided a source of electrical power 4003, which provides electrical power by cables 4004 and 4005 to a laser 4006 and a chiller 4007 for the laser 4006. The laser provides a laser beam, i.e., laser energy, that can be conveyed by a laser beam transmission means 4008 to a spool of coiled tubing 4009. A source of fluid 4010 is provided. The fluid is conveyed by fluid conveyance means 4011 to the spool of coiled tubing 4009.

The spool of coiled tubing 4009 is rotated to advance and retract the coiled tubing 4012. Thus, the laser beam transmission means 4008 and the fluid conveyance means 4011 are attached to the spool of coiled tubing 4009 by means of rotating coupling means 4013. The coiled tubing 4012 contains a means to transmit the laser beam along the entire length of the coiled tubing, i.e., "long distance high power laser beam transmission means," to the bottom hole assembly, 4014. The coiled tubing 4012 also contains a means to convey the fluid along the entire length of the coiled tubing 4012 to the bottom hole assembly 4014.

Additionally, there is provided a support structure 4015, which for example could be derrick, crane, mast, tripod, or other similar type of structure. The support structure holds an injector 4016, to facilitate movement of the coiled tubing 4012 in the borehole 4001. As the borehole is advance to greater depths from the surface 4030, the use of a diverter 4017, a blow out preventer (BOP) 4018, and a fluid and/or cutting handling system 4019 may become necessary. The coiled tubing 4012 is passed from the injector 4016 through the diverter 4017, the BOP 4018, a wellhead 4020 and into the borehole 4001.

The fluid is conveyed to the bottom 4021 of the borehole 4001. At that point the fluid exits at or near the bottom hole assembly 4014 and is used, among other things, to carry the cuttings, which are created from advancing a borehole, back up and out of the borehole. Thus, the diverter 4017 directs the fluid as it returns carrying the cuttings to the fluid and/or cuttings handling system 4019 through connector 4022. This handling system 4019 is intended to prevent waste products from escaping into the environment and either vents the fluid to the air, if permissible environmentally and economically, as would be the case if the fluid was nitrogen, returns the cleaned fluid to the source of fluid 4010, or otherwise contains the used fluid for later treatment and/or disposal.

The BOP 4018 serves to provide multiple levels of emergency shut off and/or containment of the borehole should a high-pressure event occur in the borehole, such as a potential blow-out of the well. The BOP is affixed to the wellhead 4020. The wellhead in turn may be attached to casing. For the purposes of simplification the structural components of a borehole such as casing, hangers, and cement are not shown. It is understood that these components may be used and will vary based upon the depth, type, and geology of the borehole, as well as, other factors.

The downhole end 4023 of the coiled tubing 4012 is connect to the bottom hole assembly 4014. The bottom hole assemble 4014 contains optics for delivering the laser beam 4024 to its intended target, in the case of FIG. 4, the bottom 4021 of the borehole 4001. The bottom hole assemble 4014, for example, also contains means for delivering the fluid.

Thus, in general this system operates to create and/or advance a borehole by having the laser create laser energy in the form of a laser beam. The laser beam is then transmitted from the laser through the spool and into the coiled tubing. At which point, the laser beam is then transmitted to the bottom hole assembly where it is directed toward the surfaces of the earth and/or borehole. Upon contacting the surface of the earth and/or borehole the laser beam has sufficient power to cut, or otherwise effect, the rock and earth creating and/or advancing the borehole. The laser beam at the point of contact has sufficient power and is directed to the rock and earth in such a manner that it is capable of borehole creation that is comparable to or superior to a conventional mechanical drilling operation. Depending upon the type of earth and rock and the properties of the laser beam this cutting occurs through spalling, thermal dissociation, melting, vaporization and combinations of these phenomena.

Although not being bound by the present theory, it is presently believed that the laser material interaction entails the interaction of the laser and a fluid or media to clear the area of laser illumination. Thus the laser illumination creates a surface event and the fluid impinging on the surface rapidly transports the debris, i.e. cuttings and waste, out of the illumination region. The fluid is further believed to remove heat either on the macro or micro scale from the area of illumination, the area of post-illumination, as well as the borehole, or other media being cut, such as in the case of perforation.

The fluid then carries the cuttings up and out of the borehole. As the borehole is advanced the coiled tubing is unspooled and lowered further into the borehole. In this way the appropriate distance between the bottom hole assembly and the bottom of the borehole can be maintained. If the bottom hole assembly needs to be removed from the borehole, for example to case the well, the spool is wound up, resulting in the coiled tubing being pulled from the borehole. Additionally, the laser beam may be directed by the bottom hole assembly or other laser directing tool that is placed down the borehole to perform operations such as perforating, controlled perforating, cutting of casing, and removal of plugs. This system may be mounted on readily mobile trailers or trucks, because its size and weight are substantially less than conventional mechanical rigs.

There is provided by way of examples illustrative and simplified plans of potential drilling scenarios using the laser drilling systems and apparatus of the present invention.

Drilling Plan Example 1

| | Depth | Rock type | Drilling type/Laser power down hole |
|---|---|---|---|
| Drill 17 ½ inch hole | Surface-3000 ft | Sand and shale | Conventional mechanical drilling |
| Run 13 ⅜ inch casing | Length 3000 ft | | |
| Drill 12 ¼ inch hole | 3000 ft-8,000 ft | basalt | 40 kW (minimum) |
| Run 9 ⅝ inch casing | Length 8,000 ft | | |
| Drill 8 ½ inch hole | 8,000 ft-11,000 ft | limestone | Conventional mechanical drilling |
| Run 7 inch casing | Length 11,000 ft | | |
| Drill 6 ¼ inch hole | 11,000 ft-14,000 ft | Sand stone | Conventional mechanical drilling |
| Run 5 inch liner | Length 3000 ft | | |

Drilling Plan Example 2

| | Depth | Rock type | Drilling type/Laser power down hole |
|---|---|---|---|
| Drill 17 ½ inch hole | Surface-500 ft | Sand and shale | Conventional mechanical drilling |
| Run 13 ⅜ casing | Length 500 ft | | |
| Drill 12 ¼ hole | 500 ft-4,000 ft | granite | 40 kW (minimum) |
| Run 9 ⅝ inch casing | Length 4,000 ft | | |
| Drill 8 ½ inch hole | 4,000 ft-11,000 ft | basalt | 20 kW (mimimum) |
| Run 7 inch casing | Length 11,000 ft | | |
| Drill 6 ¼ inch hole | 11,000 ft-14,000 ft | Sand stone | Conventional mechanical drilling |
| Run 5 inch liner | Length 3000 ft | | |

Figure 3:
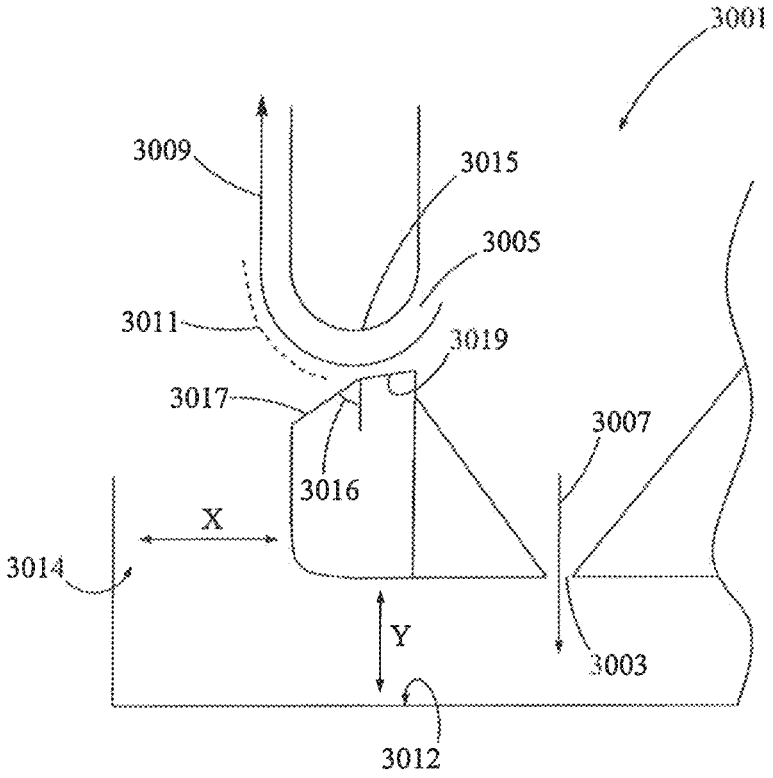
FIG. 3 is a cross sectional view of a portion of an LBHA.

There is provided in FIG. 3 an illustration of an example of a LBHA configuration with two fluid outlet ports shown in the Figure. This example employees the use of fluid amplifiers and in particular for this illustration air amplifier techniques to remove material from the borehole. Thus, there is provided a section of an LBHA 3001, having a first outlet port 3003, and a second outlet port 3005. The second outlet port, as configured, provides a means to amplify air, or a fluid amplification means. The first outlet port 3003 also provides an opening for the laser beam and laser path. There is provided a first fluid flow path 3007 and a second fluid flow path 3009. There is further a boundary layer 3011 associated with the second fluid flow path 3009. The distance between the first outlet 3003 and the bottom of the borehole 3012 is shown by distance y and the distance between the second outlet port 3005 and the side wall of the borehole 3014 is shown by distance x. Having the curvature of the upper side 3015 of the second port 3005 is important to provide for the flow of the fluid to curve around and move up the borehole. Additionally, having the angle 3016 formed by angled surface 3017 of the lower side 3019 is similarly important to have the boundary layer 3011 associate with the fluid flow 3009. Thus, the second flow path 3009 is primarily responsible for moving waste material up and out of the borehole. The first flow path 3017 is primarily responsible for keeping the optical path optically open from debris and reducing debris in that path and further responsible for moving waste material from the area below the LBHA to its sides and a point where it can be carried out of the borehole by second flow 3005.

It is presently believed that the ratio of the flow rates between the first and the second flow paths should be from about 100% for the first flow path, 1:1, 1:10, to 1:100. Further, the use of fluid amplifiers are exemplary and it should be understood that a LBHA, or laser drilling in general, may be employed without such amplifiers. Moreover, fluid jets, air knives, or similar fluid directing means many be used in association with the LBHA, in conjunction with amplifiers or in lieu of amplifiers. A further example of a use of amplifiers would be to position the amplifier locations where the diameter of the borehole changes or the area of the annulus formed by the tubing and borehole change, such as the connection between the LBHA and the tubing. Further, any number of amplifiers, jets or air knifes, or similar fluid directing devices may be used, thus no such devices may be used, a pair of such devices may be used, and a plurality of such devices may be use and combination of these devices may be used. The cuttings or waste that is created by the laser (and the laser-mechanical means interaction) have terminal velocities that must be overcome by the flow of the fluid up the borehole to remove them from the borehole. Thus for example if cuttings have terminal velocities of for sandstone waste from about 4 m/sec. to about 7 m/sec., granite waste from about 3.5 m/sec. to 7 m/sec., basalt waste from about 3 m/sec. to 8 m/sec., and for limestone waste less than 1 m/sec these terminal velocities would have to be overcome.

Figure 5:
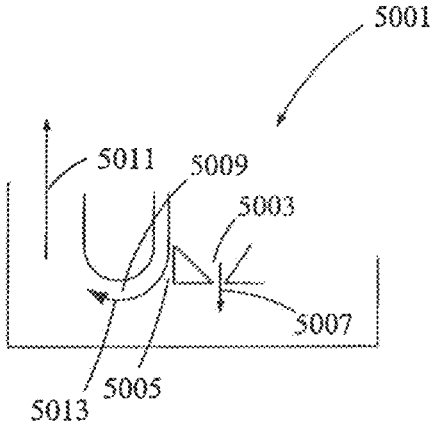
FIG. 5 is a cross sectional view of a portion of an LBHA

In FIG. 5 there is provided an example of a LBHA. Thus there is shown a portion of a LBHA 5001, having a first port 5003 and a second port 5005. In this configuration the second port 5005, in comparison to the configuration of the example in FIG. 3, is moved down to the bottom of the LBHA. There second port provides for a flow path 5009 that can be viewed has two paths; an essentially horizontal path 5013 and a vertical path 5011. There is also a flow path 5007, which is primarily to keep the laser path optically clear of debris. Flow paths 5013 and 5011 combine to become part of path 5011.

Figure 6:
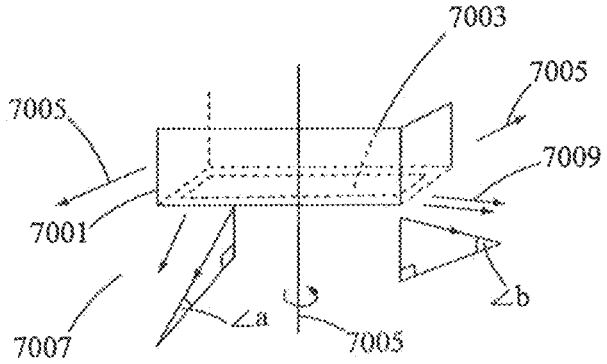
FIG. 6 is a perspective view of a fluid outlet.

There is provided in FIG. 6 an example of a rotating outlet port that may be part of or associated with a LBHA, or employed in laser drilling. Thus, there is provided a port 7001 having an opening 7003. The port rotates in the direction of arrows 7005. The fluid is then expelled from the port in two different angularly directed flow paths. Both flow paths are generally in the direction of rotation. Thus, there is provided a first flow path 7007 and a second flow path 7009. The first flow path has an angle "a" with respect to and relative to the outlet's rotation. The second flow path has an angle "b" with respect to and relative to the outlet's rotation. In this way the fluid may act like a knife or pusher and assist in removal of the material.

The illustrative outlet port of FIG. 6 may be configured to provide flows 7007 and 7009 to be in the opposite direction of rotation, the outlet may be configured to provide flow 7007 in the direction of the rotation and flow 7009 in a direction opposite to the rotation. Moreover, the outlet may be configured to provide a flow angles a and b that are the same or are different, which flow angles can range from 90° to almost 0° and may be in the ranges from about 80° to 10°, about 70° to 20°, about 60° to 30°, and about 50° to 40°, including variations of these where "a" is a different angle and/or direction than "b."

Figure 7:
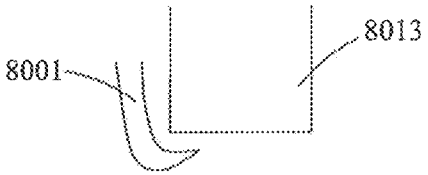
FIG. 7 is a perspective view of an air knife assembly fluid outlet.

There is provided in FIG. 7 an example of an air knife configuration that is associated with a LBHA. Thus, there is provided an air knife 8001 that is associated with a LBHA 8013. In this manner the air knife and its related fluid flow can be directed in a predetermined manner, both with respect to angle and location of the flow. Moreover, in additional to air knives, other fluid directing and delivery devices, such as fluid jets may be employed.

The novel and innovative apparatus of the present invention, as set forth herein, may be used with conventional drilling rigs and apparatus for drilling, completion and related and associated operations. The apparatus and methods of the present invention may be used with drilling rigs and equipment such as in exploration and field development activities. Thus, they may be used with, by way of example and without limitation, land based rigs, mobile land based rigs, fixed tower rigs, barge rigs, drill ships, jack-up platforms, and semi-submersible rigs. They may be used in operations for advancing the well bore, finishing the well bore and work over activities, including perforating the production casing. They may further be used in window cutting and pipe cutting and in any application where the delivery of the laser beam to a location, apparatus or component that is located deep in the well bore may be beneficial or useful.

From the foregoing description, one skilled in the art can readily ascertain the essential characteristics of this invention, and without departing from the spirit and scope thereof, can make various changes and/or modifications of the invention to adapt it to various usages and conditions.

What is claimed:

1. A method of removing debris from a borehole during laser drilling of the borehole the method comprising:

a. directing a laser beam comprising a wavelength, and having a power of at least about 10 kW, down a borehole and towards a surface of the borehole;
b. the surface being at least 1000 feet within the borehole;
c. the laser beam illuminating an area of the surface;
d. the laser beam displacing material from the surface in the area of illumination;
e. directing a fluid into the borehole and to the borehole surface;
f. the fluid being substantially transmissive to the laser wavelength;
g. the directed fluid having a first and a second flow path;
h. the fluid flowing in the first flow path removing the displaced material from the area of illumination at a rate sufficient to prevent the displaced material from interfering with the laser illumination of the area of illumination;
i. the fluid flowing in the second flow path removing displaced material from the borehole; and, wherein the laser beam is rotated and the fluid in the first flow path is directed in a direction opposite of the rotation.

2. The method of claim 1, wherein the fluid in the first fluid flow path is directed in the direction of the rotation.

3. The method of claim 1, comprising a third fluid flow path.

4. The method of claim 3, wherein the third fluid low path, and the first fluid flow path are in the direction of rotation.

5. The method of claim 3, wherein the third fluid low path, and the first fluid flow path are in a direction opposite to the direction of rotation.

6. The method of claim 1, wherein the fluid is directed directly at the area of illumination.

7. The method of claim 2, wherein the fluid in the first flow path is directed near the area of illumination.

8. The method of claim 2, wherein the fluid in the first fluid flow path is directed near the area of illumination, which area is ahead of the rotation.

9. A method of removing debris from a borehole during laser drilling of the borehole the method comprising:

a. directing a laser beam having at least about 10 kW of power towards a borehole surface;
b. illuminating an area of the borehole surface;
c. displacing material from the area of illumination;
d. providing a fluid;
e. directing the fluid toward a first area within the borehole;
f. directing the fluid toward a second area;
g. the directed fluid removing the displaced material from the area of illumination at a rate sufficient to prevent the displaced material from interfering with the laser illumination;
h. the fluid removing displaced material from the borehole; and, wherein the laser beam is rotated and the fluid directed in a direction opposite of the rotation.

10. The method of claim 9, wherein the first area is the area of illumination.

11. The method of claim 9, wherein the second area is on a sidewall of a bottom hole assembly.

12. The method of claim 9, wherein the second area is near the first area and the second area is located on a bottom surface of the borehole.

13. The method of claim 9, comprising directing the fluid to the area of illumination and further providing a second fluid directed to the second area.

14. The method of claim 13, wherein the first fluid is nitrogen.

15. The method of claim 13, wherein the first fluid is a gas.

16. The method of claim 13, wherein the second fluid is a liquid.

17. The method of claim 13, wherein the second fluid is an aqueous liquid.

18. A method of removing debris from a borehole during laser drilling of the borehole the method comprising:
a. directing a laser beam towards a borehole surface;
b. illuminating an area of the borehole surface;
c. displacing material from the area of illumination;
d. providing a fluid;
e. directing the fluid in a first path toward a first area within the borehole;
f. directing the fluid in a second path toward a second area;
g. amplifying the flow of the fluid in the second path;
h. the directed fluid removing the displaced material from the area of illumination at a rate sufficient to prevent the displaced material from interfering with the laser illumination;
i. the amplified fluid removing displaced material from the borehole; and, wherein the laser beam is rotated and the fluid in the first flow path is directed in a direction opposite of the rotation.

19. A high power laser drilling system for advancing a borehole comprising:
a. a source of high power laser energy, the laser source capable of providing a laser beam;
b. a tubing assembly, the tubing assembly having at least 500 feet of tubing, having a distal end and a proximal;
c. a source of fluid for use in advancing the borehole;
d. the proximal end of the tubing being in fluid communication with the source of fluid, whereby the fluid is transported in association with the tubing from the proximal end of the tubing to the distal end of the tubing;
e. the proximal end of the tubing being in optical communication with the laser source, whereby the laser beam can be transported in association with the tubing;
f. the tubing comprising a high power laser transmission cable, the transmission cable having a distal end and a proximal end, the proximal end being in optical communication with the laser source, whereby the laser beam is transmitted by the cable from the proximal end to the distal end of the cable; and,
wherein the laser beam is rotated and the fluid is directed in a direction opposite of the rotation; and
g. a laser bottom hole assembly in optical and fluid communication with the distal end of the tubing; and,
h. the laser bottom hole assembly comprising;
i. a housing;
ii. an optical assembly; and,
iii. a fluid directing opening.

20. The system of claim 19, wherein the fluid directing opening is an air knife.

21. The system of claim 19, wherein the fluid directing opening is a fluid amplifier.

22. The system of claim 19, wherein the fluid directing opening is an air amplifier.

23. The system of claim 19, comprising a plurality of fluid directing means.

24. The system of claim 19, wherein the bottom hole assembly comprises a plurality of fluid directing openings.

25. The system of claim 19, wherein the housing comprises a first housing and a second housing.

26. The system of claim 25, wherein the fluid directing opening is located in the first housing.

27. The system of claim 26, wherein the assembly comprises a means for rotating the first housing.

28. A high power laser drilling system for advancing a borehole comprising:
a. a source of high power laser energy, the laser source capable of providing a laser beam;
b. a tubing assembly, the tubing assembly having at least 500 feet of tubing, having a distal end and a proximal;
c. a source of fluid for use in advancing a borehole;
d. the proximal end of the tubing being in fluid communication with the source of fluid, whereby fluid is transported in association with the tubing from the proximal end of the tubing to the distal end of the tubing;
e. the proximal end of the tubing being in optical communication with the laser source, whereby the laser beam can be transported in association with the tubing;
f. the tubing comprising a high power laser transmission cable, the transmission cable having a distal end and a proximal end, the proximal end being in optical communication with the laser source, whereby the laser beam is transmitted by the cable from the proximal end to the distal end of the cable; and, wherein the laser beam is rotated and the fluid is directed in a direction opposite of the rotation; and
g. a laser bottom hole assembly in optical and fluid communication with the distal end of the tubing; and,
h. a fluid directing means for removal of waste material.

29. The system of claim 28, wherein the fluid directing means is located in the laser bottom hole assembly.

30. The system of claim 28, wherein the laser bottom hole assembly has a means for reducing the interference of waste material with the laser beam.

31. The system of claim 28, wherein the laser bottom hole assembly has rotating laser optics.

32. The system of claim 31, wherein the laser bottom hole assembly has rotating laser optics and fluid directing means.

* * * * *